US008434750B2

(12) United States Patent
Yu et al.

(10) Patent No.: US 8,434,750 B2
(45) Date of Patent: May 7, 2013

(54) POSITIONING DEVICE FOR WORKPIECES

(75) Inventors: Chi-An Yu, Taipei Hsien (TW); Ri-Qing Chen, Shenzhen (CN)

(73) Assignees: Fu Tai Hua Industry (Shenzhen) Co., Ltd., Shenzhen (CN); Hon Hai Precision Industry Co., Ltd., New Taipei (TW)

( * ) Notice: Subject to any disclaimer, the term of this patent is extended or adjusted under 35 U.S.C. 154(b) by 196 days.

(21) Appl. No.: 12/873,212

(22) Filed: Aug. 31, 2010

(65) Prior Publication Data

US 2011/0291339 A1 Dec. 1, 2011

(30) Foreign Application Priority Data

May 31, 2010 (CN) ..... 2010 1 0187166

(51) Int. Cl.
*B25B 1/22* (2006.01)

(52) U.S. Cl.
USPC ..... 269/59; 269/228; 269/71; 269/254 CS

(58) Field of Classification Search ..... 269/71, 269/43, 74, 242, 254 R, 77, 97, 143, 228, 269/254 CS; 384/504; 29/268; 16/366, 16/367, 319, 321, 322, 323, 324, 328, 353; 83/471.2, 471.3, 472, 473, 477, 477.1; 248/678, 248/680; 292/DIG. 37
See application file for complete search history.

(56) References Cited

U.S. PATENT DOCUMENTS

| | | | | |
|---|---|---|---|---|
| 1,665,819 | A * | 4/1928 | Plummer | 81/4 |
| 3,018,098 | A * | 1/1962 | Hunt | 269/91 |
| 3,063,236 | A * | 11/1962 | Cannon | 59/7 |
| 4,620,695 | A * | 11/1986 | Vanistendael | 269/24 |
| 5,775,819 | A * | 7/1998 | Kinney et al. | 384/544 |
| 7,290,760 | B1 * | 11/2007 | Lindsay | 269/75 |
| 7,673,861 | B2 * | 3/2010 | Meholovitch et al. | 269/181 |

* cited by examiner

*Primary Examiner* — Lee D Wilson
*Assistant Examiner* — Henry Hong
(74) *Attorney, Agent, or Firm* — Altis Law Group, Inc.

(57) ABSTRACT

A positioning device includes a base, a platform, a support fixed on the base, a rotatable member, and a positioning member. The rotatable member is fixed to the platform and is rotatably connected to the support. The positioning member is fixed to the platform. The positioning member is operable to cooperate with the support to lock the platform in a desired position.

8 Claims, 6 Drawing Sheets

POSITIONING DEVICE FOR WORKPIECES

BACKGROUND

1. Technical Field

The present disclosure relates to positioning devices and, particularly, to a positioning device which can position workpieces in multiple positions.

2. Description of Related Art

A positioning device is usually used to position a workpiece to be machined to a desired position. To position a number of workpieces in their respective positions, usually they need to be manually adjusted to different positions, which is time-consuming.

DETAILED DESCRIPTION

Figure 1:
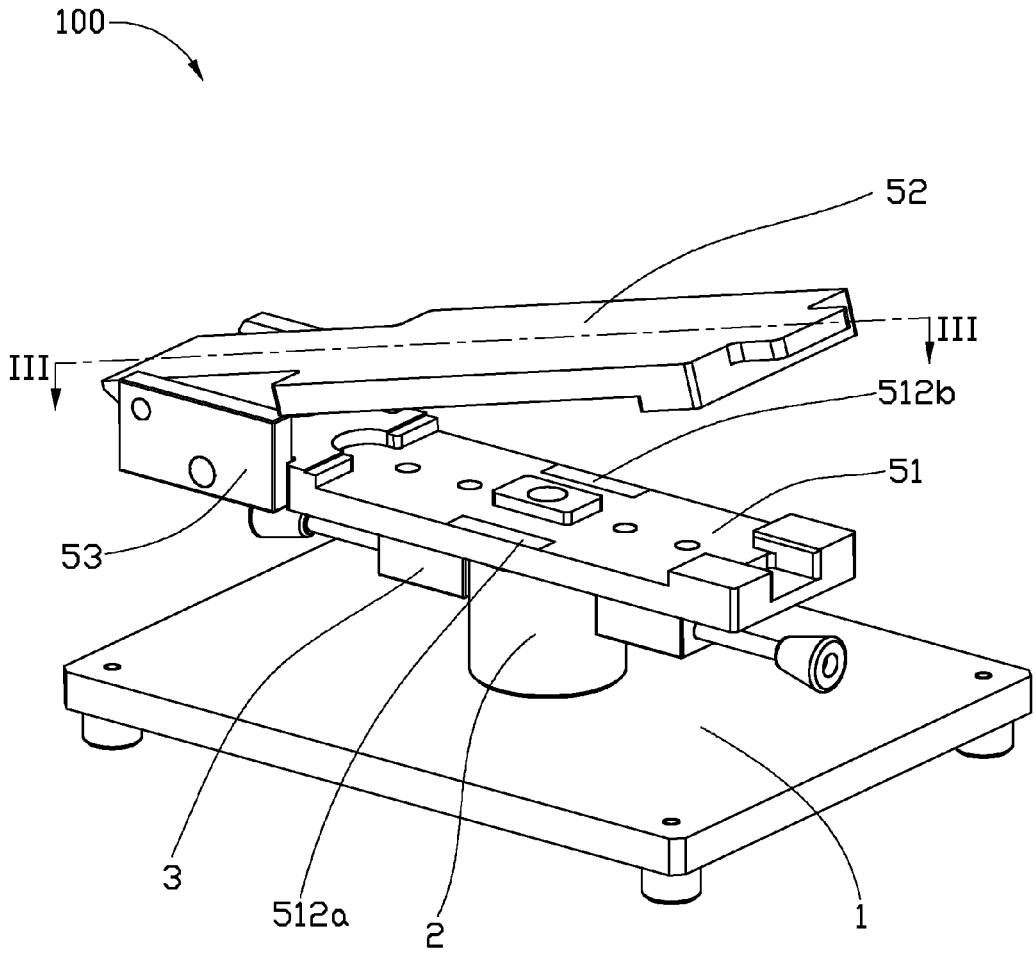
FIG. 1 is an isometric view of a positioning device in accordance with an exemplary embodiment.
Figure 2:
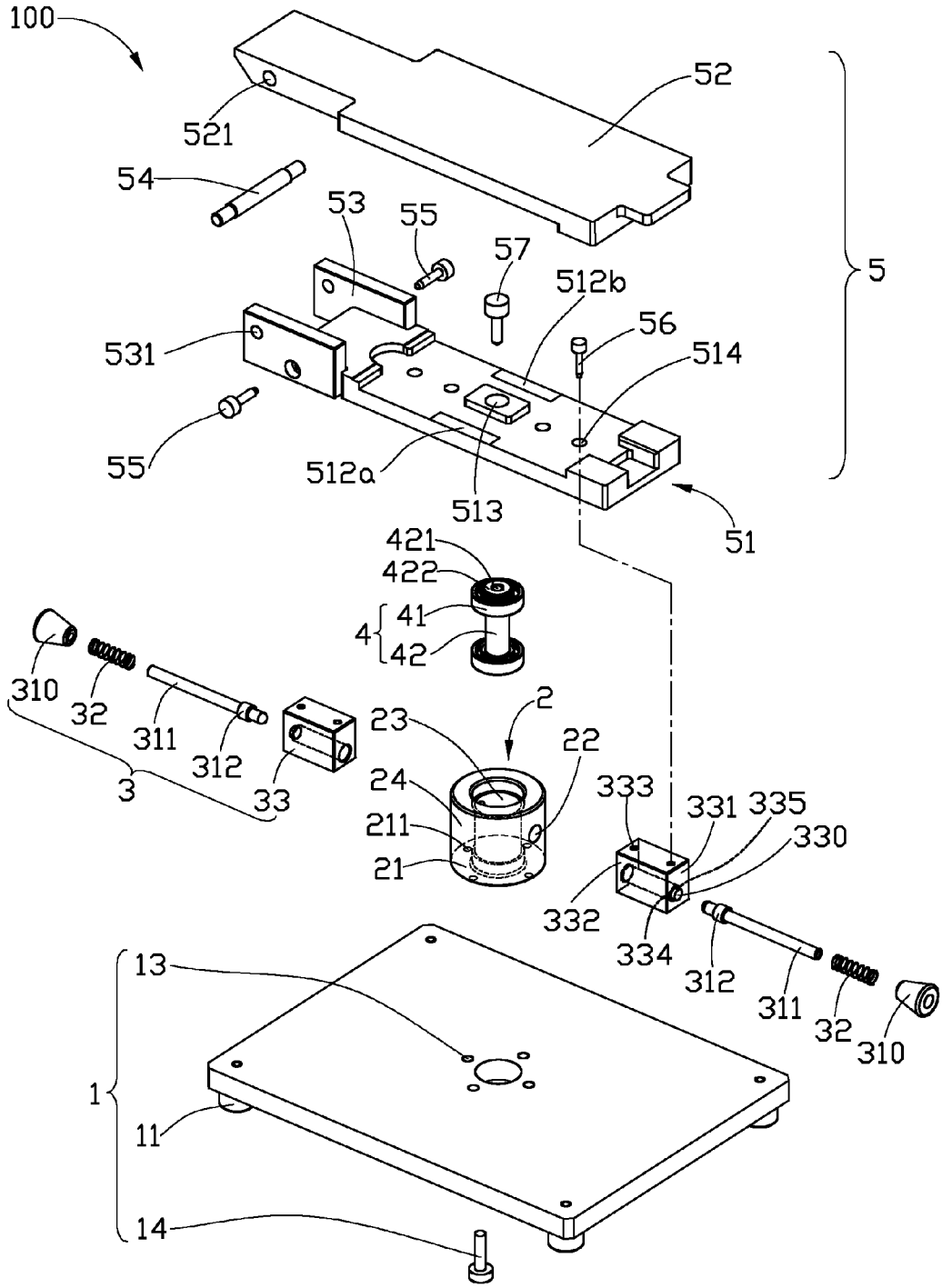
FIG. 2 is an exploded view of the positioning device of FIG. 1.

Referring to FIGS. 1-2, an embodiment of a positioning device 100 is illustrated. The positioning device 100 includes a base 1, a support 2 mounted on the base 1, two positioning members 3, a rotatable member 4, and a platform 5. The rotatable member 4 is fixed to the platform 5, and is rotatably connected to the support 2. The two positioning members 3 are fixed to the platform 5, and are operable to work with the support 2 to prevent the platform 5 from rotating relative to the base 1.

The base 1 is a substantially rectangular plate, and defines four threaded holes 13. The base 1 includes four bolts 14 and a bottom surface 10 including four feet 11 for supporting the positioning device 100 on a support surface of a tooling machine (not shown).

The support 2 is hollow, and includes a bottom surface 21, a lateral surface 24, and a receiving chamber 23 extending from one end to an opposite end. The bottom surface 21 defines four threaded holes 211 respectively opposing the four threaded holes 13 of the base 1. The four bolts 14 respectively pass through the four threaded holes 13 and 211 to fix the support 2 on the base 1. The lateral surface 24 defines two opposing holes 22. The diameter of the opposite ends of the receiving chamber 23 exceeds that of a middle portion of the receiving chamber 23.

The rotatable member 4 is received in the receiving chamber 23, and includes a body 42, and two bearings 41 arranged around opposite ends of the body 42. The two bearings 41 are fitted in the opposite ends of the receiving chamber 23, and the body 42 is rotatably received in the middle portion of the receiving chamber 23. The rotatable member 4 further includes an extending portion 422 extending from one end of the body 42. A threaded hole 421 is defined in the extending portion 422.

Each positioning member 3 includes a shaft 311, with a flange 312 arranged about the shaft 311, an elastic element 32 arranged about the shaft 311, a handle 310, and a fixing member 33. The fixing member 33 includes a first side surface 332 adjacent to the support 2 and a second side surface 331 opposing the first surface 332. The fixing member 33 defines a tapered axle hole 330 extending from the first surface 332 to the second surface 331, and two blind threaded holes 333 on its top surface. The diameter of the tapered axle hole 330 gradually decreases from the first side surface 332 to the second side surface 331. Each axle hole 330 includes a reduced hole portion 334 at one end, which forms an annular ring portion 335. The two shafts 311 pass through the tapered axle holes 330 from the first side surface 332 to the second side surface 331. Two ends of each elastic element 32 abut against the flange 312 and the annular ring portion 335. One end of each shaft 311 is fixed to the handle 310, and an opposite end is received into the hole 22 of the support 2. In one embodiment, the elastic elements 32 are coil springs.

The platform 5 is substantially parallel to the base 1, and includes a main body 51 and a workpiece fixing plate 52 rotatably connected to the main body 51. The main body 51 defines a central threaded hole 513 and two pairs of threaded holes 514 on opposing sides of the central threaded hole 513. The platform 5 further includes a central bolt 57 and two pairs of bolts 56 on opposing sides of the central bolt 57. The central bolt 57 passes through the central threaded hole 513 and the threaded hole 421 of the rotatable member 4 to fix the main body 51 to the rotatable member 4. The two pairs of bolts 56 respectively pass through the threaded holes 514 of the main body 51 and the blind threaded holes 333 of the positioning member 3 to fix the positioning member 3 to the main body 51.

The main body 51 further includes two opposing placement portions 512*a* and 512*b* for placing workpieces. The platform 5 further includes a shaft 54 and two opposing walls 53 fixed on opposite sides of the main body 51 by two bolts 55. Each wall 53 defines an axle hole 531. The workpiece fixing plate 52 defines two opposing axle holes 521. The shaft 54 passes through the axle holes 521 and 531 to rotatably connect the workpiece fixing plate 52 to the main body 51.

Figure 3:
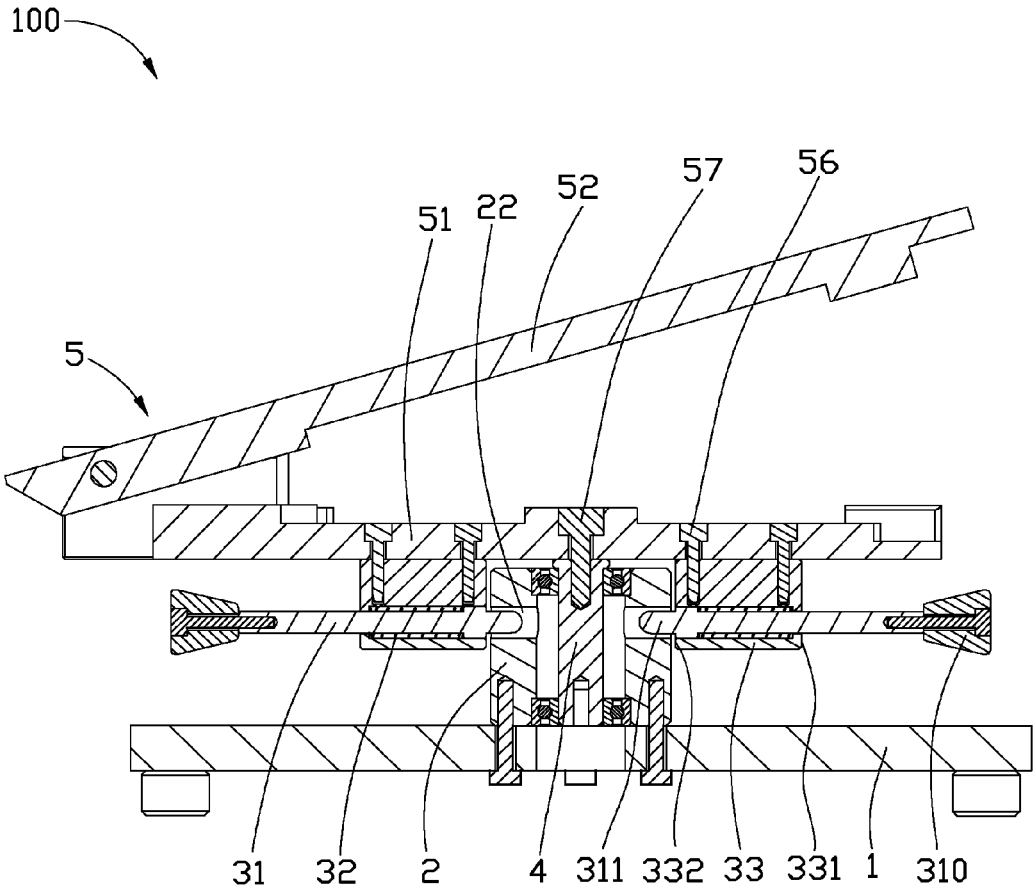
FIG. 3 is a cross-sectional view of the positioning device of FIG. 1, taken along the line III-III in FIG. 1.

Referring to FIG. 3, when in assembling, the four bolts 14 respectively pass through the threaded holes 13 and 211 to fix the support 2 on the base 1. The two shafts 311 respectively pass through the tapered axle holes 330 from the first side surface 332 to the second side surface 331 to make the two elastic elements 32 to be received in the two tapered axle holes 330. The ends of the two shafts 311 passing through the tapered axle holes 330 are respectively fixed to the handles 310, the opposite ends are received into the holes 22 of the support 2. The rotatable member 4 is received in the receiving chamber 23, thereby rotatably connecting the rotatable member 4 to the support 2. The central bolt 57 passes through the threaded holes 513 and 421 to fix the main body 51 to the rotatable member 4. The two pairs of bolts 56 respectively thread through the two pairs of threaded holes 514 and the threaded holes 333 of the positioning member 3 to fix the positioning member 3 to the main body 51. The two walls 53 are fixed on opposite sides of the main body 51 with the two bolts 55, the shaft 54 passes through the axle holes 521 and 531, thereby rotatably connecting the workpiece fixing plate 52 to the main body 51. In an initial state, the ends of two shafts 331 are respectively received into the two holes 22 of the support 2 to prevent the two positioning members 3 from rotating relative to the base 1.

Figure 4:
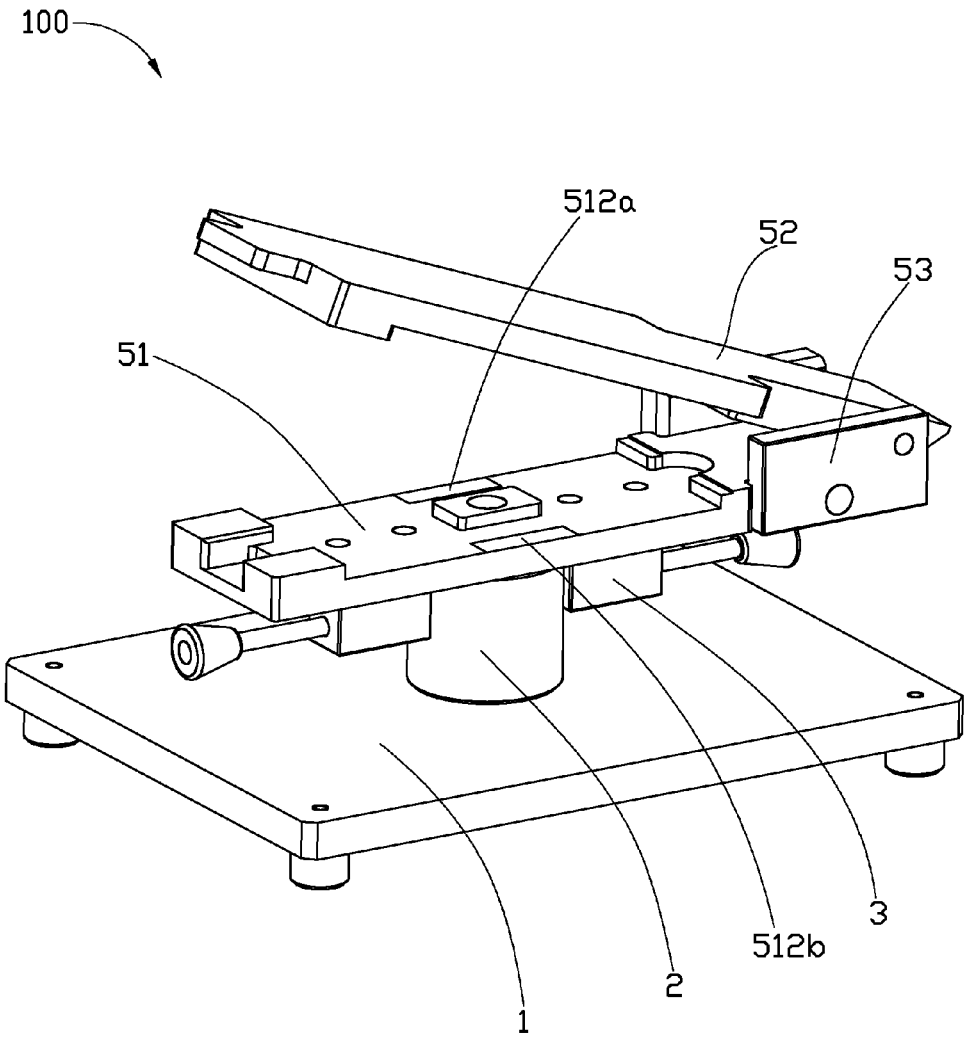
FIG. 4 is an isometric view of the positioning device of FIG. 1, viewed from another aspect.

Referring to FIG. 4, when attempting to machine a workpiece in the placement portion 512*b*, the workpiece fixing plate 52 is first opened, and the workpiece is then placed on the placement portion 512*b*. The workpiece fixing plate 52 is then closed and locked to fix the workpiece. When needed, the platform 5 can be rotated until the placement portion 512*b* locates in a desired position. To rotate the platform 5, the two handles 310 need to be pulled to cause the respective ends of the two shafts 311 to move out of the holes 22 of the support 2. Then, the two positioning members 3 are freed from the limitation of the support 2, and can be rotated together with the platform 5. After the platform 5 is rotated to the desired position, the two handles 310 can be released, and the two elastic elements 32 respectively rebound to cause the respective end of the two shafts 311 to be received in the two holes 22, thereby locking the platform 5 in the desired position. Similarly, when another desired position is need, the above operation can be repeated.

Figure 5:
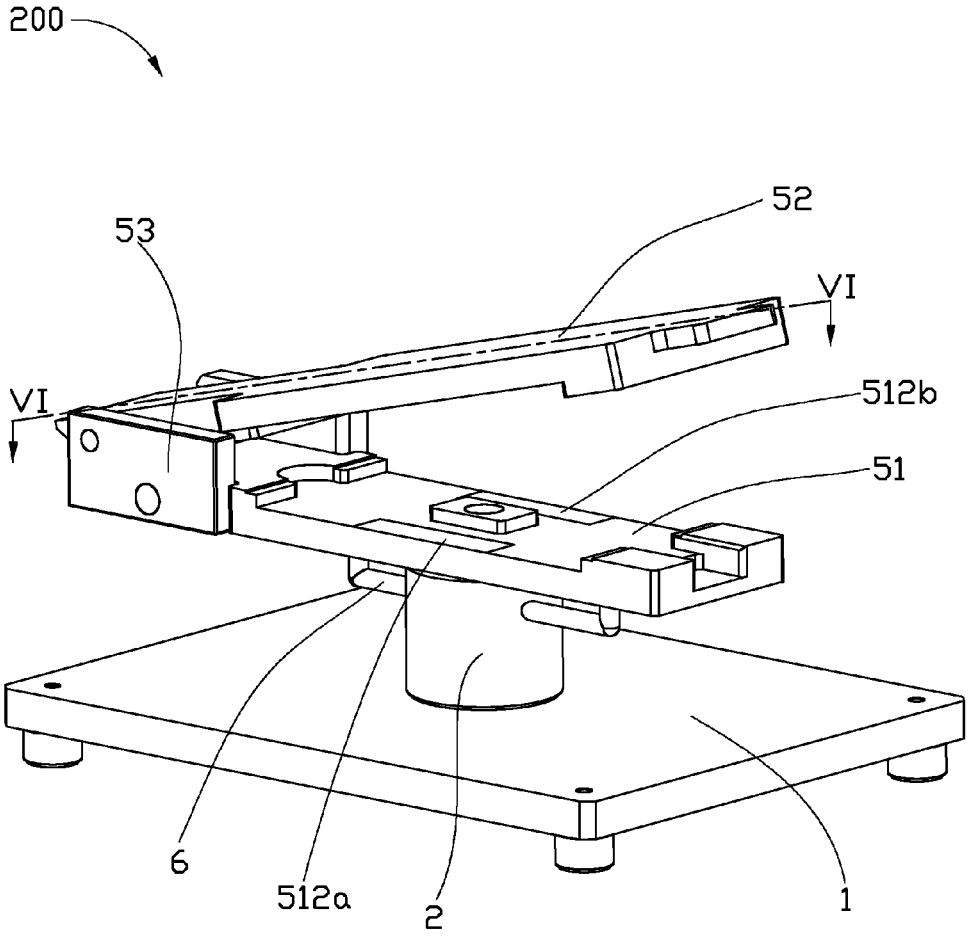
FIG. 5 is similar to FIG. 1, but showing a second embodiment of the positioning device, including a positioning member.
Figure 6:
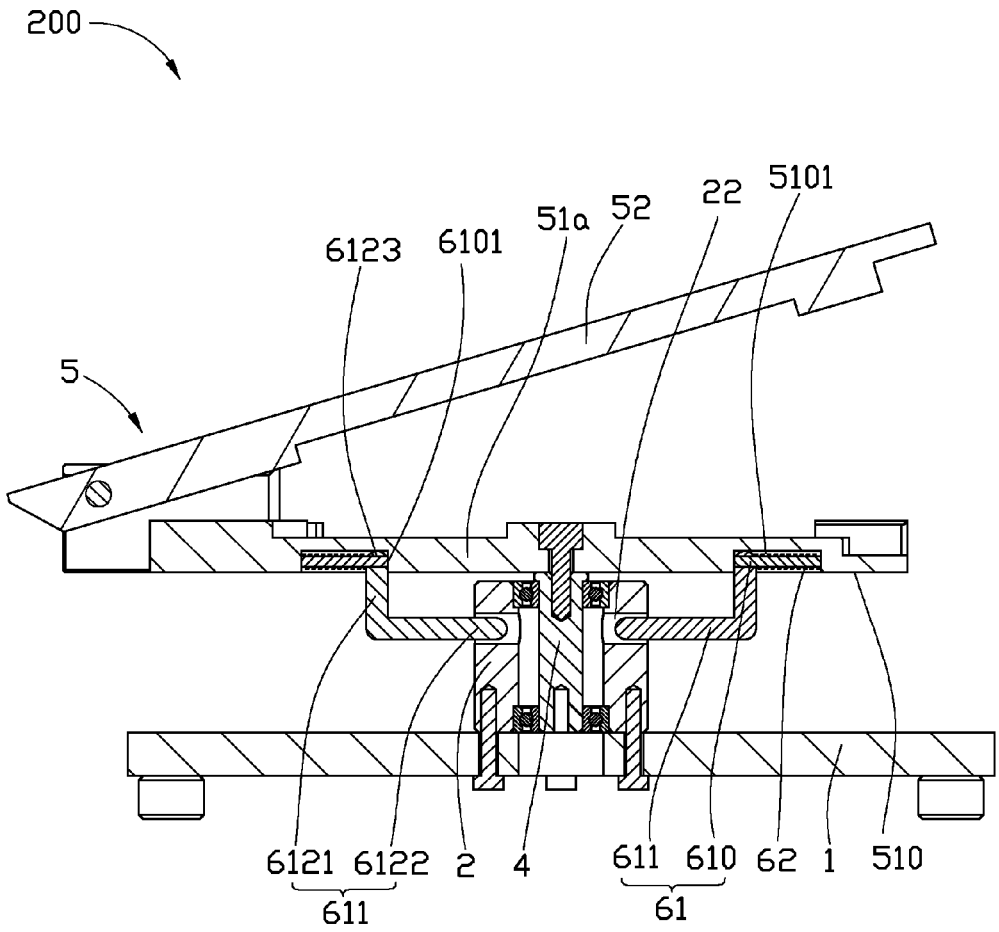
FIG. 6 is similar to FIG. 3 taken along the line VI-VI in FIG. 5, but showing the second embodiment of the positioning device of FIG. 5, defining two grooves.

Referring to FIGS. 5-6, the positioning device 200 according to a second embodiment is illustrated. The platform 5 defines two opposing grooves 5101 in a bottom surface of the main body 51*a*. The positioning device 200 includes two positioning members 6. Each positioning member 6 includes a sliding element 61 and an elastic element 62. The sliding element 61 includes a fixing pole 610 and a sliding pole 611. The fixing pole 610 is fixedly received in the groove 5101. The elastic element 62 is arranged around the fixing pole 610. The sliding pole 611 includes a handle 6122 and a connecting rod 6121 connecting the handle 6122 to the fixing pole 610. An opposite end of the connecting rod 6121 defines a hole 6123. The fixing pole 610 passes through the hole 6123, causing the connecting rod 6121 to be slidably connected to the fixing pole 610. In an initial state, the ends of the two handles 6122 are respectively received in the holes 22 of the support 2 to prevent the positioning member 6 from rotating relative to the base 1.

When attempting to machine a workpiece in the placement portion 512*b*, the workpiece fixing plate 52 is first opened, and the workpiece is then placed on the placement portion 512*b*. The workpiece fixing plate 52 is then closed and locked to fix the workpiece. When needed, the platform 5 can be rotated until the placement portion 512*b* is located to a desired position. To rotate the platform 5, the two connecting rods 6121 need to be pulled to cause the respective end of the two handles 6122 to move out of the holes 22 of the support 2. Then, the two positioning members 6 thus free from the limitation of the support 2, and can be rotated together with the platform 5. After the platform 5 is rotated to the desired position, the two connecting rods 6121 can be released, and the two elastic elements 62 respectively rebound to cause the respective ends of the two handles 6122 to be received in the two holes 22, thereby locking the platform 5 in the desired position. Similarly, when another desired position is need, the above operation can be repeated.

Although the present disclosure has been specifically described on the basis of the exemplary embodiment thereof, the disclosure is not to be construed as being limited thereto. Various changes or modifications may be made to the embodiment without departing from the scope and spirit of the disclosure.

What is claimed is:

1. A positioning device comprising:

a base;

a platform;

a support fixed on the base;

a rotatable member fixed to the platform and rotatably connected to the support; and a positioning member fixed to the platform, wherein the positioning member is operable to cooperate with the support to lock the platform in a desired position;

wherein the support comprises a lateral surface defining a hole opposing the positioning member, and a receiving chamber extending from one end to an opposite end, a diameter of the opposite end of the receiving chamber exceeds that of a middle portion of the receiving chamber, the rotatable member comprises a body and two bearings arranged around opposite ends of the body, the body is rotatably received in the middle portion of the receiving chamber, the two bearings are fitted in the opposite ends of the receiving chamber, thereby rotatably connecting the rotatable member to the support; and the rotatable member further comprises an extending portion extending from one end of the body, a threaded hole is defined in the extending portion, the platform comprises a main body and a central bolt, the main body defines a central threaded hole, the central bolt passes through the central threaded hole and the threaded hole of the rotatable member to fix the rotatable member to the platform.

2. The positioning device as described in claim 1, wherein the main body further comprises two opposing placement portions for supporting workpieces, the platform further comprises a workpiece fixing plate rotatably connecting to the main body, the workpiece fixing plate is configured for fixing the workpieces on the two placement portions.

3. The positioning device as described in claim 2, wherein the platform further comprises a shaft and two opposing walls fixed on opposite sides of the main body, each of the two walls defines an axle hole, the workpiece fixing plate defines two opposing axle holes, the shaft of the platform passes through the axle holes of the two walls and the workpiece fixing plate, thereby rotatably connecting the workpiece fixing plate to the main body.

4. A positioning device comprising:

a base;

a platform;

a support fixed on the base;

a rotatable member fixed to the platform and rotatably connected to the support; and a positioning member fixed to the platform, wherein the positioning member is operable to cooperate with the support to lock the platform in a desired position;

wherein the support comprises a lateral surface defining a hole opposing the positioning member, and a receiving chamber extending from one end to an opposite end, a diameter of the opposite end of the receiving chamber exceeds that of a middle portion of the receiving chamber, the rotatable member comprises a body and two bearings arranged around opposite ends of the body, the body is rotatably received in the middle portion of the receiving chamber, the two bearings are fitted in the opposite ends of the receiving chamber, thereby rotatably connecting the rotatable member to the support; and the positioning member comprises a shaft, a flange arranged about the shaft, an elastic element arranged about the shaft, a handle, and a fixing member, the fixing member comprises a first side surface adjacent to the support and a second side surface opposing the first side surface, and the fixing member defines a tapered axle hole from the first side surface to the second side surface, a diameter of the tapered axle hole gradually decreases from the first side surface to the second side surface, each tapered axle hole comprises a reduced portion at one end, which forms an annular ring portion, the shaft passes through the tapered axle hole from the first side surface to the second side surface, two ends of the elastic element abut against the flange and the annular portion, one end of the shaft passing through the tapered axle hole is fixed to the handle, and an opposite end is received in the hole of the support to prevent the rotatable member from rotating relative to the base.

5. The positioning device as described in claim 4, wherein the fixing member further defines two blind threaded holes, the main body further defines two threaded holes, the platform further comprises two bolts, the two bolts respectively thread through the two threaded holes of the main body and the two blind threaded holes to fix the positioning member to the platform.

6. The positioning device as described in claim 5, wherein when to rotate the platform relative to the base, the handle need to be pulled to cause one end of the shaft to move out of the hole of the support, the positioning member is forced to rotate together with the platform relative to the base.

7. The positioning device as described in claim 5, wherein after the platform is rotated to a desired position, the elastic element rebounds to cause the end of the shaft to be received in the hole of the support, thereby locking the platform in the desired position.

8. The positioning device as described in claim 4, wherein the elastic element is a coil spring.

* * * * *